US012312883B2

(12) United States Patent
Baudoin

(10) Patent No.: US 12,312,883 B2
(45) Date of Patent: May 27, 2025

(54) SAFETY SEPARATION APPARATUS AND METHOD

(71) Applicant: Toby Scott Baudoin, Rayne, LA (US)

(72) Inventor: Toby Scott Baudoin, Rayne, LA (US)

( * ) Notice: Subject to any disclaimer, the term of this patent is extended or adjusted under 35 U.S.C. 154(b) by 52 days.

(21) Appl. No.: 18/345,578

(22) Filed: Jun. 30, 2023

(65) Prior Publication Data

US 2025/0003299 A1 Jan. 2, 2025

(51) Int. Cl.
*E21B 19/16* (2006.01)
*E21B 23/04* (2006.01)

(52) U.S. Cl.
CPC ..... *E21B 19/16* (2013.01); *E21B 23/0413* (2020.05)

(58) Field of Classification Search
CPC ..... E21B 17/06; E21B 17/04; E21B 17/046; E21B 17/0465; E21B 17/02; E21B 17/041; E21B 19/16; E21B 23/0413; E21B 17/07
See application file for complete search history.

(56) References Cited

U.S. PATENT DOCUMENTS 4,066,282 A * 1/1978 Vann ..... E21B 43/116 285/39
4,452,472 A 6/1984 Crase
5,419,399 A 5/1995 Smith
6,053,250 A 4/2000 Echols
6,349,305 B1 8/2002 Bakke
7,152,674 B2 12/2006 Bowles
7,174,963 B2 2/2007 Bertelsen
7,650,946 B2 1/2010 Gazewood
7,836,958 B2 11/2010 Gazewood
8,418,771 B2 4/2013 Sach
8,464,788 B2 6/2013 Stanford
9,267,338 B1 2/2016 LeBlanc et al.
9,605,493 B2 3/2017 Lauder
9,771,762 B2 9/2017 Baudoin
10,648,290 B2 5/2020 Fears et al.
2014/0060854 A1 3/2014 Baudoin
2014/0110129 A1 4/2014 Schmidt
2015/0226018 A1* 8/2015 Baudoin ..... E21B 31/00 166/242.6
2020/0224504 A1 7/2020 Ruttley et al.
2020/0291730 A1* 9/2020 Schultz ..... E21B 17/046

FOREIGN PATENT DOCUMENTS

CA 2887293 C 6/2022

* cited by examiner

*Primary Examiner* — Yanick A Akaragwe

(57) ABSTRACT

A safety separation apparatus for use on a workstring disposed in a wellbore is comprised of a tubular upper member attached to the workstring, a tubular bottom member attached to a DTA, and a translatable tubular piston positioned within the tubular upper member and tubular bottom member of the safety separation apparatus. The tubular upper member has upper member fingers threadedly engaged with threads within the interior surface of the tubular bottom member. The tubular piston has a seat surface where a release ball may be seated and a plurality of collapsible piston fingers engaged with a piston finger groove within the tubular bottom member. Fluid pressure on the release ball inserted in the tubular piston will translate the tubular piston to collapse the piston fingers for disengagement of the bottom member and the attached DTA from the upper member and the attached workstring.

17 Claims, 3 Drawing Sheets

SAFETY SEPARATION APPARATUS AND METHOD

FIELD OF THE INVENTION

This invention relates to equipment for oil and gas wells. More specifically, it pertains to a safety separation apparatus for use on a workover or drill string such as a coiled tubing, drill pipe, or tubing and, more particularly, this invention relates to an apparatus for separating a pipe string from a downhole tool assembly (known as a DTA).

BACKGROUND OF THE INVENTION

During the drilling, completion, work over, or plug and abandonment of oil and gas wellbore, an operator may perform downhole operations by means of a variety of downhole tools that are attached to a string of pipe or tubing such as a workover string, a drill string, or to a coiled tubing string (each referred to separately herein as a "workstring"). Such downhole tools are typically operated within the wellbore by means of fluid circulating through the workstring. During downhole operations, an operator may choose to leave a portion of the workstring or the downhole tools in the wellbore. It may also be the case that the workstring becomes stuck and the need arises to safely release a portion of the workstring or downhole tools. The use of a safety separation apparatus on a workstring allows the operator to separate the workstring to allow its lower portion with a DTA to remain in the wellbore while its upper portion is removed from the wellbore. Doing so will allow an operator to later reenter the wellbore with a workstring for performing additional wellbore operations.

Some safety separation apparatuses employ a mechanical separation mechanism, but the majority employ a hydraulic separation mechanism. Many safety separation apparatuses employ shear devices that use shear screws, shear rings, or shear pins. Often these shear devices either shear prematurely or are unreliable in separating. The use of a downhole extended reach tool or tools (ERT) as part of a DTA has become necessary in drilling and completing today's extended reach wells. The use of an ERT can produce high amplitude pulses on the order of 2000-2500 psi that exert extreme forces on tools running above an ERT which often include downhole separation apparatus. These extreme forces often prematurely shear screws or pins, shift pistons, and the like when elements are employed in a safety separation apparatus.

Workstring tools must also be designed with sufficient clearances between parts to allow their assembly. The pulses from an ERT can cause wear between mating parts, which result in increasing the clearances in a safety separation apparatus that is employed on a workstring. This increase in clearances, often referred to as "slack," can be detrimental to the performance of a safety separation apparatus including a reduction in its longevity, an increase the potential for its premature separation, the failure of the safety separation apparatus to perform its function. This is frequently the case for a safety separation apparatus that employs pins, dogs, keys, or other forms of latching devices to "lock" an upper portion of the safety separation apparatus to a lower portion.

The designs of many safety separation apparatuses also suffer because components, such as pistons, dogs, balls, or pins, are often left inside the lower portion of the safety separation apparatus that remains in the wellbore when the lower portion of the safety separation apparatus is separated from its supper portion. Leaving components in the lower portion of a safety separation apparatus may prevent an operator from reattaching to, or fishing out, the remaining lower portion of the workstring. Leaving components in the lower portion of a safety separation apparatus may also prohibit an operator from circulating fluid through the remaining lower portion and an attached workstring segment, even if reattachment is accomplished.

Consequently, there is a need for a safety separation apparatus that overcomes these shortcomings and that safely and reliably allows an operator to separate a workstring from a DTA.

SUMMARY OF THE INVENTION

A safety separation apparatus for use on a workstring disposed in a wellbore is disclosed to satisfy the aforementioned needs. The disclosed safety separation apparatus is comprised of a tubular upper member, a tubular bottom member, and a translatable tubular piston. The tubular upper member has a threaded connection on its upper or first end for threaded connection to the workstring or to another downhole tool on the workstring and a plurality of threaded upper member fingers at its lower or second end. The tubular bottom member has a threaded internal surface that engages with the threaded upper member fingers and a threaded connection at its lower end for threaded connection directly to a DTA or to a workstring segment positioned above a DTA.

The translatable tubular piston is positioned within the upper member and bottom member of the safety separation apparatus and has a plurality of longitudinally extending piston fingers at its lower end. An enlarged portion on the lower outer surface of each of the piston fingers is configured to engage an internal finger recess in the bottom member. The central bore of the tubular piston is configured with an internal profile that creates a ball seat for a release ball circulated through the workstring. When the release ball is circulated, the release ball will be seated upon the ball seat and substantially interrupt the flow of fluid from the workstring. Seating the release ball prevents the exit of such fluid from the safety separation apparatus causing an increase in the fluid pressure in the workstring and the safety separation apparatus.

The increase of pressure in the safety separation apparatus will force the piston fingers to collapse inwardly away from the finger recess in the bottom member and translate or shift the piston downward in response to the pressure increase. When the piston is shifted downward, only a small upward tensile force need be applied from the workstring to the upper member of the safety separation apparatus in order to cause the upper member fingers to collapse inwardly and allow the upper member of the safety separation apparatus, along with the piston and circulation ball, to be separated from the bottom member to allow its removal from the wellbore, leaving the bottom member of the safety separation apparatus clear of the upper member and free for subsequent fishing or circulation operations. These and other advantages of the safety separation apparatus will be apparent from the disclosures provided herein.

In the interest of descriptive clarity these drawings may omit features that are well established in the art and that do not bear upon points of novelty. Such features may include hoses, hydraulic couplings, pumps, motors, fluid reservoirs, controls, gauges, threaded junctures, weld lines, sealing elements, screws, bolts, pins, brazed junctures, and the like.

DESCRIPTION OF THE EMBODIMENTS

Figure 1:
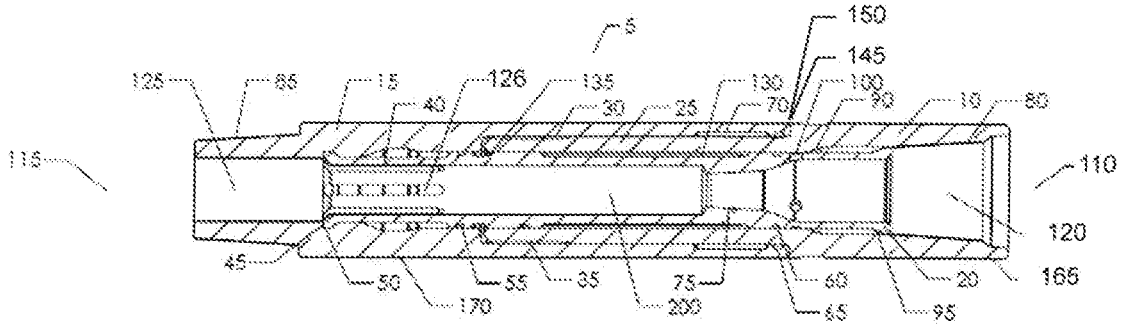
FIG. 1 is a longitudinal cross-sectional view of the safety separation apparatus.
Figure 2:
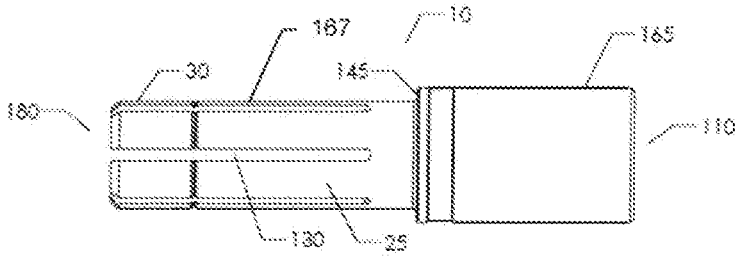
FIG. 2 is an elevation view of the upper member of the safety separation apparatus shown in FIG. 1.
Figure 3:
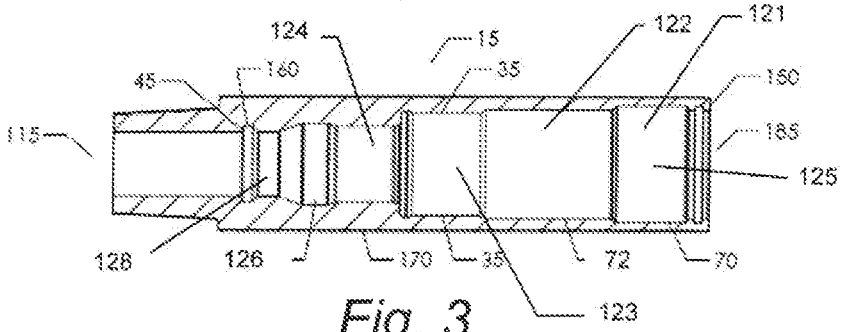
FIG. 3 is a longitudinal cross-sectional view of the bottom member of the safety separation apparatus shown in FIG. 1.
Figure 4:
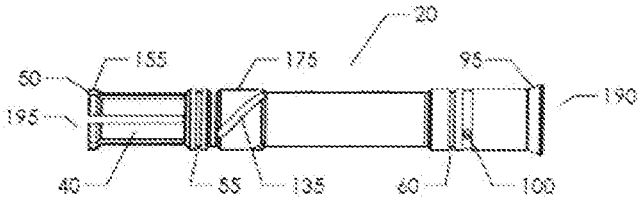
FIG. 4 is an elevation view of the piston of the safety separation apparatus shown in FIG. 1.

FIG. 1 shows an embodiment of the safety separation apparatus (5) of the present invention utilized to provide a means of hydraulic separation of a workstring from a downhole tool assembly (DTA) should such a need arise. The apparatus (5) is comprised of a tubular upper member (10), a tubular bottom member (15), and a translatable tubular piston (20). FIGS. 2-4 are illustrative views of the upper member (10), the bottom member (15), and the translatable tubular piston (20) which make up the safety separation apparatus (5).

As shown in FIGS. 1-3, the tubular upper member (10) is comprised of a central bore (120), an upper end (110) having a workstring threaded box connection (80), a lower end (180), a first tubular segment (165), and a recessed second tubular segment (167) that creates an external radial shoulder (145). The central bore (120) of the upper member (10) is configured to provide an internal radial shoulder surface (90). Longitudinal slots (130) through the recessed second tubular segment (167) of the upper member (10) extend from the lower end (180) of the upper member (10) toward the external shoulder (145) to form a plurality of longitudinally extending upper member fingers (25) having an area of exterior or outer threads (30).

The tubular bottom member (15) has an upper end (185), a lower end (115) having a workstring threaded pin connection (85), a radial outer or exterior surface (170), and an internal bore (125). The internal bore (125) of tubular bottom member (15) is configured to receive the recessed second tubular segment (167) of the upper member (10) and has a first internal bore section (121) having internal surface (70), a second internal bore section (122), a third internal bore (123) having an area of internal threads (35) configured to threadedly engage with the exterior or outer threads (30) provided around the upper member fingers (25), a narrowed fourth internal bore section (124), and an expanded fifth internal bore section (126), and a narrowed sixth internal bore section (128) with a radial shoulder (45) and an internal radial groove (160). The threaded engagement of the outer threads (30) around the upper member fingers (25) with the internal threads (35) of the bottom member (15) will compress together the radial shoulder (145) of upper member (10) against shoulder (150) of tubular bottom member (15).

The translatable tubular piston (20), shown in FIG. 1 and FIG. 4, is configured to be concentrically received within the internal bore (120) of upper member (10) and the internal bore (125) of the bottom member (15) of the safety separation apparatus (10). The translatable tubular piston (20) has an upper end (190), a lower end (195), an expanded exterior radial surface (175), and an internal bore (200) configured with an internal radial surface (75) creating a ball seat for a release ball. A plurality of piston fingers (40) extends longitudinally from the expanded radial surface (175) to the lower end (195) of the translatable tubular piston (20). An upper radial shoulder (95) on the translatable tubular piston (20) is positioned for translatable engagement with the internal shoulder (90) in the upper member (10). Fluid ports (100) are provided for an ancillary fluid flow path and to adjust pressure.

Each of the piston fingers (40) of the translatable piston (20) has a lower shoulder (50) that is positioned to be in contact with the radial shoulder (45) of the internal bore section (128) of the bottom member (15) and an external profile feature (155) that is configured to be both concentrically and axially located within the internal groove (160) in the internal bore section (128) of the tubular bottom member (15). Interlocking the piston finger profile feature (155) of each piston finger (40) with the groove (160) provides a means to both locate the translatable tubular piston (20) in the proper axial position and to lock the translatable tubular piston (20) firmly within safety separation apparatus (5).

The groove (160) is shown as a continuous groove that extends radially around the interior surface of the internal bore section (128) of the internal bore (125) of the tubular bottom member (15). However, the groove (160) could be comprised of a plurality of individual grooves or recesses on the interior radial surface of the internal bore section (128) of the internal bore (125) of the tubular bottom member (15) each individual groove or recess positioned to interlock with a corresponding piston finger profile feature (155) of a piston finger (40) to both locate the translatable tubular piston (20) in the proper axial position and to lock the translatable tubular piston (20) firmly within safety separation apparatus (5).

FIG. 1, a longitudinal cross-sectional view of the apparatus (5), shows its upper member (10) connected to its bottom member (15) and with its translatable tubular piston (20) in a connected or unshifted position. In this connected or unshifted position, the translatable tubular piston (20) is held in place by the contact of its lower shoulder (50) with the internal shoulder (45) of the bottom member (15) and by the external profile feature (155) of the piston fingers (40) located within internal groove (160) in bottom member (15). The translatable tubular piston (20) is also held in place within the apparatus (5) by friction created from applying torque between upper member (10) and bottom member (15) during their threaded attachment. When torque is applied, the upper member fingers (25) tend to "squeeze" inward to place radial forces around the translatable tubular piston (20) thereby causing static friction. The translatable tubular piston (20) is thus substantially unable to move axially relative to the safety separation apparatus (5) when placed in this configuration.

When the translatable tubular piston (20) is properly positioned within safety separation apparatus (5), the expanded external surface (175) of piston (20) is at least partially aligned in an axial direction beneath thread (30) of upper member (10) (as shown in FIG. 1). This alignment prohibits upper member fingers (25) from collapsing. The outer diameter of the expanded external surface (175) of the translatable tubular piston (20) is sized just slightly smaller than the bore of upper member fingers (25) to provide a sliding fit.

External groves (55) and (60) may be provided on the translatable tubular piston (20) for the placement of sealing elements to seal the translatable tubular piston (20) relative to bottom member (15) and upper member (15), respectively. In lieu of placing sealing elements on external groves (55) and (60), sealing elements may be placed in grooves (135) in the protruding external surface (175) of the translatable tubular piston (20) and in the bottom member (15) which is within the scope of this disclosure. A labyrinth seal (not shown) may also be utilized in lieu of the illustrated sealing elements. The sealing elements may not be necessary to the function of the apparatus (5), if the clearance between the translatable tubular piston (20) and upper member (10) is kept extremely small. The elimination of the sealing elements may simplify the assembly of the safety separation apparatus (5), however, elimination of the sealing elements would cause a slight increase in the difficulty of manufacture of the apparatus (5).

Figure 7:
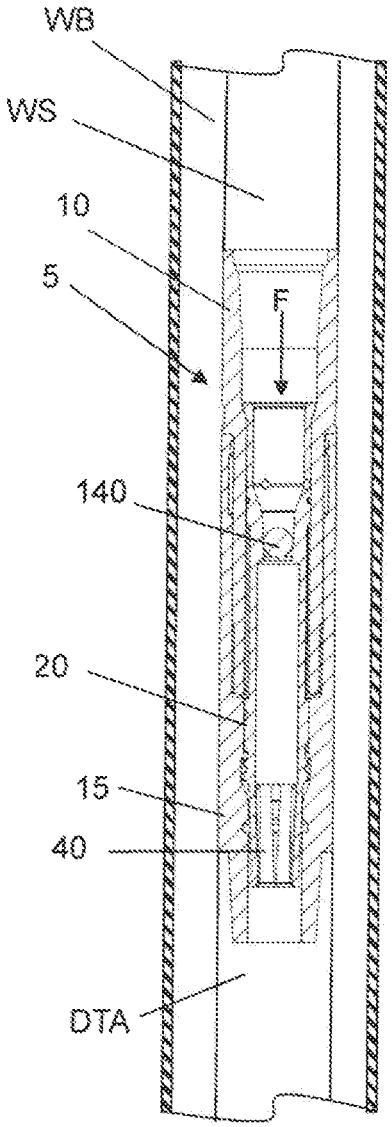
FIG. 7 is a longitudinal cross-sectional view of the safety separation apparatus shown in FIG. 1 attached to a workstring above a DTA with the piston in a shifted position but prior to separation of the bottom member of the safety separation apparatus from its upper member.

The threaded box connection (80) at the upper end (110) of upper member (10) is configured for connecting the apparatus (5) to a workstring (WS) as shown in FIG. 7. The threaded pin connection (85) at the lower end (115) of tubular bottom member (15) is configured for connecting the apparatus (5) to a DTA or to a workstring segment positioned above a DTA. The outer surface (165) of upper member (10) and the outer surface (170) of tubular bottom member (15) provide apparatus (5) with an outer cylindrical surface that corresponds with the outer surface of the workstring (WS) and permits circulation fluid (F) from the connected workstring to enter the internal bore (120) of upper member (10), flow through safety separation apparatus (5), and exit from the internal bore (125) of tubular bottom member (15).

Figure 5:
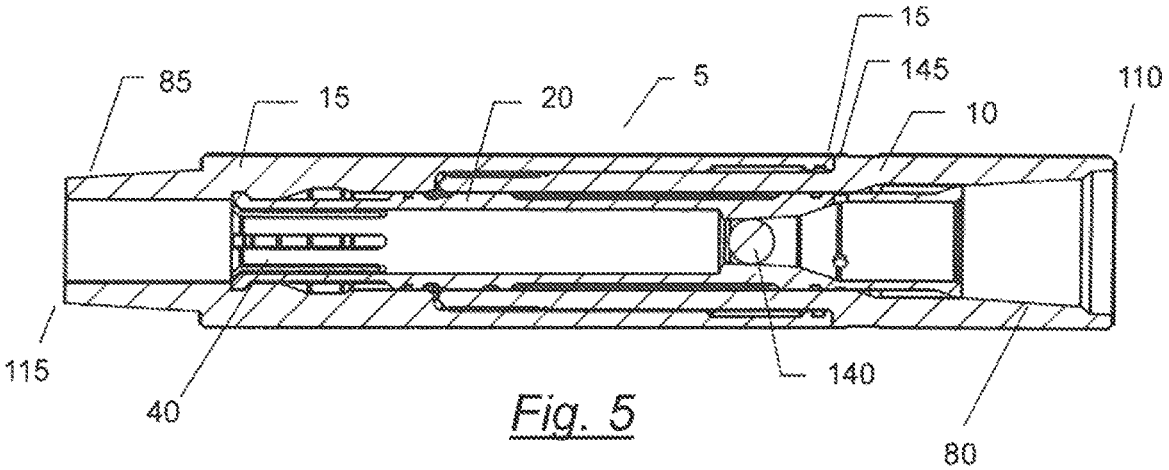
FIG. 5 is a longitudinal cross-sectional view of the safety separation apparatus shown in FIG. 1 with a ball on the ball seat and with the piston in an unshifted position.

FIG. 5 is a longitudinal cross-section view of safety separation apparatus (5) with a release ball (140) seated on internal profile (75) within the central bore (200) of the translatable tubular piston (20). Once an operator deems it necessary to separate from a downhole tool assembly (DTA) or workstring, a release ball of correct size is pumped from the surface (drilling rig or coil tubing unit) through the workstring (WS) and circulated down the workstring (WS) until it seats on internal profile (75) of the translatable tubular piston (20). When the release ball (140) is seated, the flow of fluid through the central bore (200) of the translatable tubular piston (20) and thus the apparatus (5) is stopped.

Figure 6:
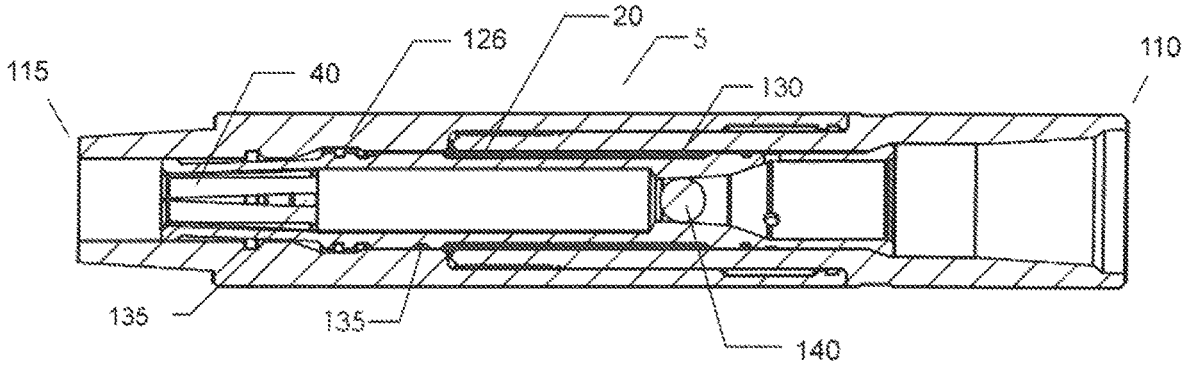
FIG. 6 is a longitudinal cross-sectional view of the safety separation apparatus shown in FIG. 1 with a ball on the ball seat and with the piston in a shifted position.

Further fluid circulation in the workstring (WS) will create an increase in pressure above the release ball (140). This increase in pressure will begin urging the translatable tubular piston (20) downward until such time that the increase in pressure is sufficient to cause piston fingers (40) of the translatable tubular piston (20) to collapse thereby translating or shifting the translatable tubular piston (20) downward to engage to engage its radial shoulder (95) with the internal radial shoulder (90) of the upper member (10) to place the apparatus (5) into the release position shown in FIG. 6. When the apparatus (5) is in the release position, the upper member fingers (25) are no longer supported by the outer surface (175) of the translatable tubular piston (20) that keeps the external threads (30) of upper member (10) engaged with internal threads (35) of tubular bottom member (15).

Figure 8:
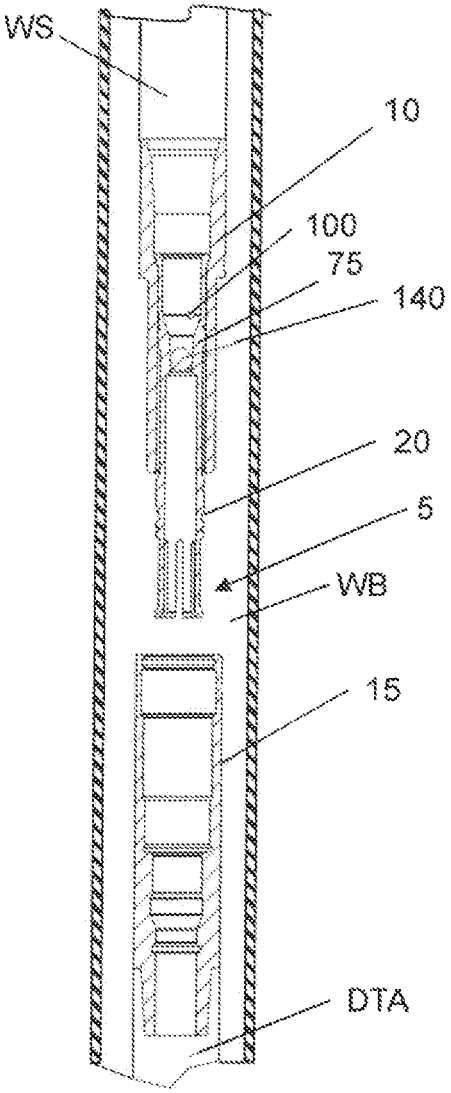
FIG. 8 is a longitudinal cross-sectional view of the safety separation apparatus shown in FIG. 1 in a wellbore after separation of the bottom member of the safety separation apparatus from its upper member.

When the release ball (140) is seated on internal profile (75), the operator will see a pressure spike at surface followed by a sudden drop in pressure. This spike and sudden drop in pressure indicates that the translatable tubular piston (20) has shifted to the release position and that the safety separation apparatus (5) is ready for separation. The operator may then apply a tensile force on the upper member (10) of the apparatus (5) by beginning to withdraw the workstring (WS) and the attached upper member of the apparatus (5) from the wellbore (WB). As shown in FIG. 8, during the withdrawal of the workstring (WS) and the upper member (10) of the apparatus (5), the translatable tubular piston (20) remains in the shifted position with its piston fingers (40) relaxed to their original shape and the release ball (140) remains seated on internal profile (75) of the translatable tubular piston (20) to leave a clean, unobstructed bottom member (15) in the wellbore. The fluid ports (100) in the piston (20) allow for circulation of fluid (F) around the release ball (140) after the bottom member (15) is separated from the upper member (10) of the apparatus (5).

When the upper portion of the apparatus (5) is removed, a subsequent fishing operation to retrieve the remaining portion of the workstring or DTA in the wellbore or other wellbore operations may then be performed.

It can be seen by one skilled in the art that all three components including upper member (10), bottom member (15) and piston (20) can be easily and readily manufactured using standard CNC machining practices and tooling.

It is thought that the inventive concepts of the apparatus and method of the present invention and their attendant and inherent advantages will be understood from the foregoing description and it will be apparent that various changes may be make in the form, construction and arrangement of the apparatus parts and method steps thereof without departing from the spirit and scope of the present invention or sacrificing its material advantages, the apparatus and methods described herein being merely exemplary embodiments of the invention.

What is claimed is:

1. A safety separation apparatus, comprising:

(a) A tubular upper member having an internal upper member bore, a first segment, a recessed second segment, said recessed second segment comprising a plurality of longitudinally extending upper member fingers, said upper member fingers having a threaded area;

(b) a tubular bottom member having an internal bottom member bore configured for receiving said recessed second segment of said tubular upper member, said tubular bottom member having an internal surface having a threaded area configured for threadable engagement with said threaded area of said upper member fingers; and (c) a translatable tubular piston concentrically located within said tubular upper member and within said tubular bottom member, said translatable tubular piston having a central piston bore, a plurality of piston fingers, each said piston finger of said plurality of piston fingers having an external profile translatably engageable with an internal groove on said internal surface of said tubular bottom member.

2. The safety separation apparatus recited in claim 1, wherein said central piston bore includes a ball seat surface.

3. The safety separation apparatus recited in claim 2, wherein said translatable tubular piston has an expanded external surface at least partially aligned in an axial direction beneath said threaded area of said upper member fingers.

4. The safety separation apparatus recited in claim 3 wherein said tubular upper member includes a threaded box connection and wherein said tubular bottom member includes a threaded pin connection.

5. The safety separation apparatus recited in claim 4 wherein said threaded box connection is connected to a workstring.

6. The safety separation apparatus recited in claim 5 wherein said threaded pin connection is connected to a downhole tool assembly.

7. The safety separation apparatus recited in claim 6 wherein said downhole tool assembly includes a workstring segment.

8. A safety separation apparatus, comprising:

(a) A tubular upper member having a threaded box connection connected to a first workstring, an internal upper member bore, a first segment, a recessed second segment, said recessed second segment comprising a plurality of longitudinally extending upper member fingers, said upper member fingers having a threaded area;

(b) a tubular bottom member having a threaded pin connection connected to a second workstring, an internal bottom member bore configured for receiving said recessed second segment of said tubular upper member, said tubular bottom member having an internal surface having a threaded area configured for threadable engagement with said threaded area of said tubular upper member fingers, said internal surface of said tubular bottom member having an internal groove;

(c) a translatable piston concentrically located within said tubular upper member and within said tubular bottom member, said translatable piston having a plurality of piston fingers, each said piston finger of said plurality of piston fingers having an external profile translatably engaged with said internal groove of said tubular bottom member; and (d) a ball seat surface included in a central piston bore of said translatable piston.

9. The safety separation apparatus recited in claim 8 further comprising a release ball engageable with said ball seat surface.

10. The safety separation apparatus recited in claim 9 further comprising a fluid introduced into said central piston bore of said translatable piston whereby said release ball is seated on said ball seat surface.

11. The safety separation apparatus recited in claim 10 further comprising pressure in said central piston bore created by said fluid on said seated release ball on said ball seat surface, said pressure translating said translatable tubular piston whereby each external profile of each piston finger of said plurality of piston fingers is translatably disengaged from said internal groove of said tubular bottom member.

12. The safety separation apparatus recited in claim 11 wherein each said piston finger of said plurality of piston fingers of said translatable piston is inwardly collapsed when said plurality of piston fingers is disengaged from said internal groove of said tubular bottom member.

13. The safety separation apparatus recited in claim 12 whereby said tubular upper member of said safety separation apparatus is released from said tubular bottom member of said safety separation apparatus by a tensile force on said first workstring.

14. A method for separation of a workstring from a downhole tool assembly comprising:

a) providing a safety separation apparatus comprising:

i) A tubular upper member having an internal upper member bore, a first segment, a recessed second segment, said recessed second segment comprising a plurality of longitudinally extending upper member fingers, said upper member fingers having a threaded area;

ii) a tubular bottom member having an internal bottom member bore configured for receiving said recessed second segment of said tubular upper member, said tubular bottom member having an internal surface having a threaded area threadably engaged with said threaded area of said tubular upper member fingers, said internal surface of said tubular bottom member having an internal groove; and iii) a translatable tubular piston concentrically located within said tubular upper member and within said tubular bottom member, said translatable piston having a plurality of piston fingers, each said piston finger of said plurality of piston fingers having an external profile translatably engaged with said internal groove of said tubular bottom member, and a central piston bore, said central piston bore having a ball seat surface;

b) connecting said tubular upper member of said safety separation apparatus to a workstring having a central fluid bore;

c) connecting said tubular bottom member of said safety separation apparatus to a downhole tool assembly;

d) inserting said workstring, said connected safety separation apparatus, and said connected downhole tool assembly into a wellbore;

e) providing a release ball;

f) pumping a flow of fluid with said release ball through said central fluid bore of said workstring into said central piston bore of said translatable tubular piston; and g) seating said release ball on said ball seat surface of said central piston bore of said translatable tubular piston.

15. The method for separation of a workstring from a downhole tool assembly recited in claim 14, further comprising the additional step of continuing said pumping of said flow of fluid into said central piston bore of said translatable tubular piston thereby increasing the fluid pressure in said workstring and said safety separation apparatus whereby said piston fingers of said tubular piston collapse inwardly away from said internal groove of said tubular bottom member to shift said tubular piston downward.

16. The method for separation of a workstring from a downhole tool assembly recited in claim 15, further comprising the additional step of applying an upward tensile force on said workstring whereby said tubular upper member and said tubular translatable piston of said safety separation apparatus are disengaged from said tubular bottom member of said safety separation apparatus.

17. The method for separation of a workstring from a downhole tool assembly recited in claim 16, wherein said tubular bottom member of said safety separation apparatus and said connected downhole tool assembly is left in said wellbore.

* * * * *